US009492710B2

(12) United States Patent
Franson et al.

(10) Patent No.: US 9,492,710 B2
(45) Date of Patent: Nov. 15, 2016

(54) NECK PROTECTOR

(71) Applicants: Stephen Scott Franson, Hampton, NH (US); Paul Marston, North Hampton, NH (US)

(72) Inventors: Stephen Scott Franson, Hampton, NH (US); Paul Marston, North Hampton, NH (US)

( * ) Notice: Subject to any disclaimer, the term of this patent is extended or adjusted under 35 U.S.C. 154(b) by 0 days.

(21) Appl. No.: 14/320,354

(22) Filed: Jun. 30, 2014

(65) Prior Publication Data

US 2015/0005147 A1 Jan. 1, 2015

Related U.S. Application Data

(60) Provisional application No. 61/841,103, filed on Jun. 28, 2013.

(51) Int. Cl.

| | |
|---|---|
| ***A63B 23/025*** | (2006.01) |
| ***A63B 26/00*** | (2006.01) |
| ***A63B 21/00*** | (2006.01) |
| ***A63B 23/12*** | (2006.01) |

(52) U.S. Cl.

CPC ..... *A63B 26/00* (2013.01); *A63B 21/0005* (2013.01); *A63B 21/00047* (2013.01); *A63B 21/00054* (2013.01); *A63B 23/1236* (2013.01); *A63B 2208/028* (2013.01); *A63B 2208/0276* (2013.01)

(58) Field of Classification Search

CPC ..... A61G 1/04; A63B 2021/0786

See application file for complete search history.

(56) References Cited

U.S. PATENT DOCUMENTS

| | | | | |
|---|---|---|---|---|
| 4,964,418 | A * | 10/1990 | Wilson | 128/857 |
| 5,295,949 | A | 3/1994 | Hathaway | |
| 6,106,437 | A | 8/2000 | Brooks | |
| 6,110,080 | A | 8/2000 | Niv | |
| 6,179,747 | B1 | 1/2001 | Kelly | |
| 6,190,288 | B1 | 2/2001 | Fihser | |
| 6,939,269 | B2 | 9/2005 | Makofsky | |
| 7,010,814 | B2 | 3/2006 | Benziger | |
| 7,390,286 | B1 | 6/2008 | Edgeton | |
| 8,172,737 | B1 | 5/2012 | Nihlman et al. | |
| 2006/0052219 | A1 | 3/2006 | Roberts et al. | |
| 2014/0265487 | A1 * | 9/2014 | Michelson | 297/256.11 |

* cited by examiner

*Primary Examiner* — Loan H Thanh
*Assistant Examiner* — Rae Fischer
(74) *Attorney, Agent, or Firm* — Gearhart Law LLC

(57) ABSTRACT

An exercise assistance apparatus including a u shaped module comprised of a plurality sides of varying widths, heights and lengths. The module is adapted and configured to receive and support the head, shoulders and cervical spine of an individual. The module includes a base connected to the plurality of sides. The apparatus may include a plurality of sides of equal widths, heights and lengths. The plurality of sides may be separate pieces or interconnected. The module may also include a plurality of component pieces. The plurality of sides may be adjustable in width, height and length. The module may be made of plastic, foam, wood or metal. The module can be stacked vertically to achieve a desired height. The module may have an interior that is hollow or filled with water or sand. The sides of the module may have rounded lateral edges. The base of the module may include pads for non-skidding. The apparatus may come in a variety of sizes.

12 Claims, 1 Drawing Sheet

NECK PROTECTOR

CLAIM OF PRIORITY

This application claims priority to U.S. provisional patent application No. 61/841,103 filed Jun. 28, 2013 the disclosure of which is incorporated herein by reference in their entirety for any purpose whatsoever.

FIELD OF THE EMBODIMENTS

The present invention relates to an apparatus used during the execution of an exercise.

BACKGROUND OF THE EMBODIMENTS

Crossfit advocates a mix of aerobic exercise, body weight exercise, gymnastics and weight lifting. Crossfit can be described as strength and conditioning mixed exercises which involve constantly varied, high intensity, functional movements. Crossfit workouts are typically short in duration, intense, and demanding all-out physical exertion. Crossfit exercises include but are not limited to movements such as sprinting, rowing, jumping rope, climbing rope, flipping tires, weightlifting, carrying heavy objects, and many bodyweight exercises; equipment used includes barbells, dumbbells, gymnastics rings, pull-up bars, kettlebells, medicine balls, boxes for box jumps, handstands and handstand pushups. Crossfit exercises, such as handstand pushups access a person's physical skills, including a person's cardiovascular/respiratory endurance, stamina, strength, flexibility, power, speed, agility, balance, coordination, and accuracy.

Crossfit exercising programming can be found in private affiliated gyms, fire departments, law enforcement agencies, military organizations and high school and college physical education programs and sports teams. The crossfit workout requires strength training or endurance exercises to be completed in as many repetitions possible in a certain amount of time. For this reason, a persons may sacrifice form in exchange for finishing a workout quicker. When it comes to strength training or endurance exercises, improper form, at high speeds is the surest way to get seriously injured. For example, when completing a handstand pushup, if a person does not have somebody spotting them or telling them to keep their form correct, then injury will likely occur. The present invention seeks to solve this problem by providing an apparatus which allows for correct form and decreased pressure on the shoulders by providing protection to a person's head and cervical spine.

A handstand is a gymnastic move that occurs when a person balances on her hands with their legs straight in the air. Doing a handstand requires strength and flexibility of the muscles and joints in the body. A handstand pushup requires a person be inverted with their feet in the air. The higher a person's feet, the more stress is placed on the shoulders and neck. The present invention solves the inherent danger to a persons, joints, neck and shoulder when doing handstand pushups by creating a cradle for the head and cervical spine.

Many human joints are used in a handstand pushup. A person's hinge joints are located in the elbows, knees and ankles. During a handstand, the joint in the elbow is locked to allow the arms to become straight and support the weight of the body. The joint in the knees and ankles are also used when bringing the legs up in the air and keeping the legs straight and feet pointed. A person's pivot joint connects the first and second vertebrae together at the base of the skull and allows for neck rotation. A persons ball and socket joints are located at the hip and the shoulder. The ball and socket joint in the hip allows the legs to rotate upward. In the shoulder, the ball and socket join allows a person's arms to rotate above the head to support the body in a handstand pushup. Lastly, the condyloid joint in the wrist allows the wrist to be bent at a 90-degree angle, inward, outward or in a circular motion during a handstand pushup.

There are many methods of accomplishing a handstand pushup but each method has an inherent danger that can be lessened by using the present invention. For instance, a handstand pushup may begin with a person's back against a wall. A person may then lift their hands above their head while making sure their arms are straight. A person may either step forward and throw their hands down and kick up or a person may bend at the waist wherein both hands are placed on the floor at shoulder width. Ultimately, the body is upside down with the arms and legs fully extended straight. Using a wall allows a person to kick themselves up against the wall with their arms straight. Once inverted, a person then slowly lowers oneself to the ground as they inhale until their head almost touches the floor. A person then raises oneself away from the ground and repeats the exercise.

In another method, a person may kick one leg in front of them, take a large step forward with that leg, lean forward while keeping their body straight, and allow their body to invert over their lunged leg while simultaneously using some force to propel ones back foot upwards. Once inverted and straight, a person can proceed to lower and raise their body. The most common mistake in a handstand pushup is to throw ones hands straight down at the ground and try to throw ones legs upward. This results in a whip at the top and causes a person to fall forward. Allowing the shoulders to sag upwards or elbows bend also risks injury. The present invention would not allow a person's shoulders to sag by having the shoulders rest on the apparatus and thus aid in the elbows not bending.

The present invention would seek to allow a person to come down slow in order to prevent a head injury. In addition, the present invention creates stability when the floor surface is not stable or is slippery. In addition, the present invention can act as a "spotter" when one is not present. The present invention will assist is keeping a person's head neutral and in one place. This would allow a person to look down rather than flailing their head in order to assess their proximity to the wall or support. The apparatus will also ensure that a person's head is not inadvertently thrown back. The present invention also solves the problem of having to use an unstable prop such as a tree or box.

Handstand pushups, when done improperly can cause a large amount of compression to the brachial plexus, pinching of nerves in the shoulder, and twinges in the elbows. Serious neck injuries can also occur when completing a handstand improperly such as, cervical spinal stenosis whose symptoms include numbness, tingling or electricity pain in the arm, hands or fingers; cervicogenic headaches, whose symptoms include moderate to severe head pain, limited mobility of the neck, pain in the shoulder, neck, or arm, nausea, dizziness, blurred vision, swallowing difficulties, swelling, and/or sensitivity to light or to loud noises; neck sprain or strain; wrist pain; osteoarthritis of the neck; and hyperextension/hyperflexion, which is more commonly known as whiplash where loss of neck motion is possible.

However, when done correctly, a handstand pushup can build core strength and greater flexibility and mobility. With the present invention, a person head is fit snugly into the apparatus such that a cradle of protection is created around the head and cervical spine when inverted. An athlete's shoulders will make contact with the device in such a way as to prevent a head-strike while descending or when in the inverted position. The apparatus allows a person to safely invert such that a person does not have to dangerously kickoff a wall or tree.

Conventional apparatus known in the exercising arena include, U.S. Pat. No. 8,172,737 entitled, Back Handspring Training Device. Such a device provides back support and not head and neck support like the present invention. In addition, such an apparatus is counter to crossfit exercises. Such an apparatus teaches a person how to correctly practice for gymnastics and not actually assists a person in doing gymnastics, a crossfit exercise.

In U.S. Pat. No. 6,179,747 entitled, One Piece Face and Neck Exerciser, the apparatus enables people to use their neck and face muscles and is not used for injury prevention. The present invention ensures that a person does not use their neck muscles and instead uses shoulder and hand strength to avoid neck strain.

U.S. Pat. No. 7,010,814 entitled, Weight Bearing Headwear teaches a weight fitted under a hat or other type or headwear as another way to strengthen neck muscles. Unlike the present invention, the headwear taught does not prevent injury. The present invention is also not concerned with building neck and facial muscles, but shoulder and hand muscles.

In U.S. Pat. No. 5,295,949, entitled Modular Neck Apparatus, the apparatus is used for the treatment of injuries to the neck. The present apparatus is used for the prevention of injuries to the neck.

SUMMARY OF THE EMBODIMENTS

The present invention relates to an exercise assistance apparatus including a u shaped module comprised of a plurality of sides of varying widths, heights and lengths. The module is adapted and configured to receive and support the head, shoulders and cervical spine of an individual. The module includes a base connected to the plurality of sides. The apparatus may include a plurality of sides of equal widths, heights and lengths. The plurality of sides may be separate pieces or interconnected. The module may also include a plurality of component pieces. The plurality of sides may be adjustable in width, height and length. The module may be made of plastic, foam, wood or metal. The module can be stacked vertically to achieve a desired height. The module may have an interior that is hollow or filled with water or sand. The sides of the module may have rounded lateral edges. The base of the module may include pads for non-skidding. The apparatus may come in a variety of sizes.

DESCRIPTION OF THE PREFERRED EMBODIMENTS

Figure 1A:
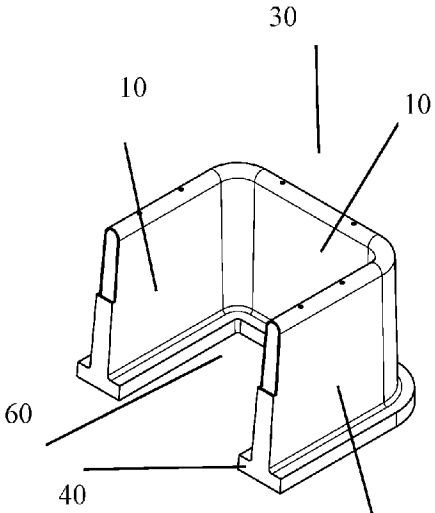
FIG. 1A-1F shows perspective views of the embodiment of the invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 1B:
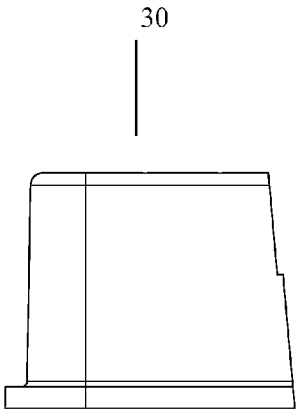
Figure 1C:
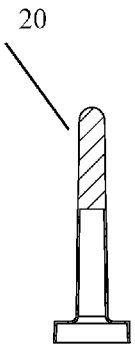
Figure 1D:
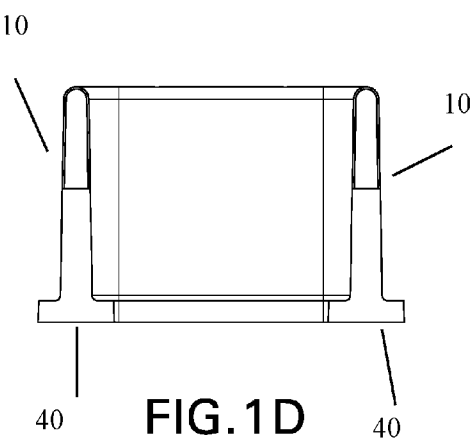
Figure 1E:
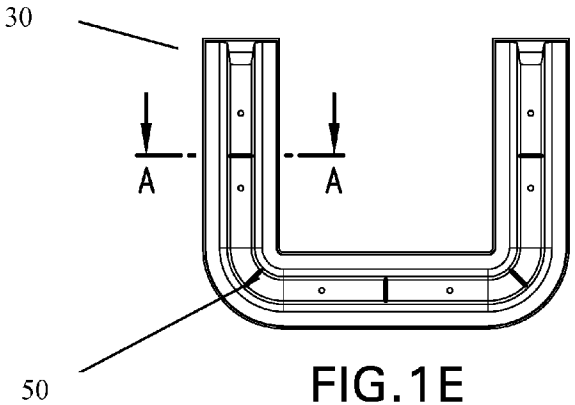
Figure 1F:
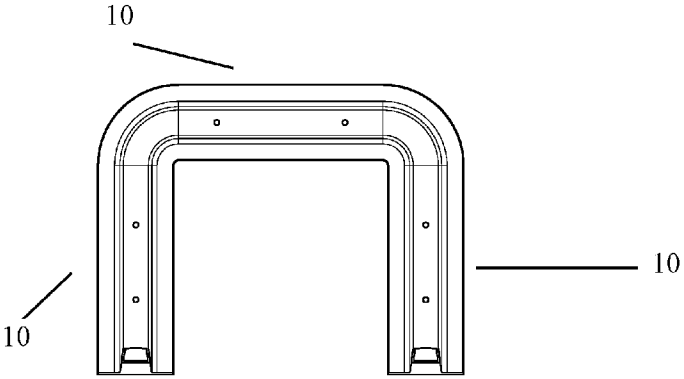

The neck protector apparatus as shown in FIG. 1A is comprised of a u-shaped module. The module is comprised of three walls which form the "u-shape." The length, width and height of the apparatus may vary depending on the user the walls or sides 10 of the module 30 include rounded lateral edges 20. FIG. 1B and 1C shows the side view of the apparatus, FIG. 1D shows the rear view, FIG. 1E shows the top view, and FIG. 1F shows the bottom view of the apparatus. The walls 10 are connected to a base 40 which fares out for additional support. In another embodiment, the neck protector apparatus is comprised of a one piece u-shaped module measuring in varying lengths, widths and heights.

When stacked one top of the other, each neck protector apparatus creates additional height. This slows allows for less range of motion when a person is inverting. The module may be 17 inches wide and 11 inches in height but its width and height may vary depending on the head and shoulders of an individual exerciser.

The neck protector apparatus provides protection to the head and spine of a person or athlete during the execution of or during the attempt at executing a hand-stand pushup. When used properly, the basic design prevents a person or athlete from striking the head on the ground while performing a handstand, handstand push-up or related maneuver. The neck protector apparatus creates a cradle of protection around the head and cervical spine when inverted. A person's or athlete's shoulders will make contact with the module in such a way as to prevent a head-strike while descending or when in the inverted position.

The neck protector apparatus protects the cervical spine from head impact with floor surfaces during execution of a handstand pushup. The neck protector apparatus also reduces concussive forces on the crown of head (i.e. skull) when doing a handstand pushup.

The neck protector apparatus ensures that a person's shoulders touch the unit as an inversion is done while their head is fit snug inside 60 the apparatus.

The apparatus will be able to support human weight up to and above 300 lbs. The unique design of the neck protector apparatus allows a user to create additional assistance in exercising when multiple units are stacked vertically. For example, when stacked, the neck protector apparatus will allow for greater height which allows for a person to invert with less range of motion. The apparatus includes a flared bottom to ensure the apparatus does not slide away, whether up against a wall or not.

In another embodiment, the neck protector 30 apparatus may be is a one piece, foam injection molded apparatus, made from plastic and whose interior 50 is hollow. In another embodiment, the neck protector apparatus may be filled with substances which can provide additional support and weight such as sand. The neck protector apparatus may be available in different sizes, such as small, medium or large, to accommodate heads of all sizes. In another embodiment, the height of the unit can be adjusted by adjusting the wall height on the individual apparatus or as mentioned above, by stacking one apparatus on top of another.

The neck protector apparatus is lightweight and waterproof and can easily be transported and used indoors or outdoors and in all types of training environments, including but not limited to, gymnastic and martial art facilities and gymnasiums. The neck protector apparatus is available in a variety of colors and the design and materials allow for an inexpensive and attractive option for all levels of exercisers. The neck protector apparatus can be used by persons or athletes who are beginners or novices at handstand pushups or other similar crossfit exercises.

In another embodiment of the present application, the apparatus may support the knees, hands and buttocks of an individual. In another embodiment, the module is wrapped in a vinyl material or cushioned.

The many elements of the present invention make it unique in the field. The novelty is illustrated by the various options for nearly every aspect of the invention that allow it to be used in the proper exercise form by a variety of users, both in terms of body size and fitness level. Additionally, there is a wide range of exercises available to any user of the present invention, and users can perform exercises that use the upper and lower extremity muscle groups simultaneously.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An exercise assistance apparatus including:

a u-shaped module comprised of a plurality of sides having rounded lateral edges and arranged to form an inner space; and a base connected to the plurality of sides and shaped to extend horizontally beyond the vertical surfaces of each of the plurality of sides;

wherein the inner space is configured to receive the head and cervical spine of a user when performing inverted exercises; and wherein the plurality of sides are configured to support the shoulders of the user when performing inverted exercises.

2. The apparatus of claim 1, wherein each of the sides are of equal widths, heights and depths.

3. The apparatus of claim 1, wherein the plurality of sides are of varying widths, heights and depths.

4. The apparatus of claim 1, wherein the plurality of sides are formed as separate individual pieces.

5. The apparatus of claim 1, wherein the plurality of sides and the base are formed as an integral and contiguous piece.

6. The apparatus of claim 1, wherein the plurality of sides are configured to be adjustable in width.

7. The apparatus of claim 1, wherein the u-shaped module is made of plastic, foam, wood and metal.

8. The apparatus of claim 1, wherein the u-shaped module is configured to be stacked vertically with other modules to achieve a desired height.

9. The apparatus of claim 1, wherein each of the plurality of sides comprises a hollow interior and is configured to contain water or sand.

10. The apparatus of claim 1, further comprising a pad attached to the base to prevent skidding.

11. The apparatus of claim 1, wherein the plurality of sides are configured to be adjustable in height.

12. The apparatus of claim 1, wherein the plurality of sides are configured to be adjustable in depth.

* * * * *